United States Patent [19]

Hutton

[11] Patent Number: 4,760,253

[45] Date of Patent: Jul. 26, 1988

[54] MASS SPECTROMETER

[75] Inventor: Robert C. Hutton, Nantwich, England

[73] Assignee: VG Instruments Group Limited, Crawley, England

[21] Appl. No.: 8,468

[22] Filed: Jan. 29, 1987

[30] Foreign Application Priority Data

Jan. 31, 1986 [GB] United Kingdom ..... 8602463

[51] Int. Cl.[4] ..... H01J 49/04

[52] U.S. Cl. ..... 250/288; 250/281

[58] Field of Search ..... 250/281, 288, 282, 423 R

[56] References Cited

FOREIGN PATENT DOCUMENTS 0112004 6/1984 European Pat. Off. .

OTHER PUBLICATIONS

Gray, A. L., Int. J. Mass Spectrom. and Ion Phys., 1983, vol. 46, pp. 7–10.

Date, A. R., Int. J. Mass Spectrom. and Ion Phys., 1983, vol. 48, pp. 357–360.

Date, A. R., The Analyst, 1983, vol. 108, pp. 159–165.

Olivares, J. A., Analytical Chemistry, 1985, vol. 57, pp. 2674–2679.

European Spectroscopy News, 1982, vol. 43.

Gray, A. L., Dynamic Mass Spectroscopy, vol. 6, ch. 20.

Houk, Fassel et al., Analytical Chemistry, 1980, vol. 52, p. 2283.

Gray, A. L., The Analyst, 1983, vol. 108, pp. 1033–1050.

Date, A. R., Spectrochimica Acta B 1983, vol. 38B, pts. 1 & 2, pp. 29–37.

*Primary Examiner*—Bruce C. Anderson

*Assistant Examiner*—Jack I. Berman

*Attorney, Agent, or Firm*—Bacon & Thomas

[57] ABSTRACT

The invention provides a mass spectrometer adapted for the elemental analysis of a sample in which ions are formed from the sample in an inductively coupled plasma (ICP). The flame of the plasma (14) is directed against the front surface (30) of a cone (19), and ions are sampled from the plasma through a hole (16) in the apex of the cone. In order to reduce the intensity of the background mass spectra, the rear surface (32) of the inside of the cone is polished to a surface finish of 5 microns or better, at least in the vicinity of the hole.

6 Claims, 3 Drawing Sheets

MASS SPECTROMETER

This invention relates to a mass spectrometer in which ions are generated from a sample in an inductively-coupled plasma (ICP).

Mass spectrometers having an ion source comprising an ICP discharge in argon can be used for the determination of the elemental composition of a sample dissolved in a solution. In such a spectrometer, the solution is introduced by means of a nebuliser through which a controlled flow of argon is passed. The argon is then fed to an ICP discharge similar to those used conventionally in atomic emission spectroscopy. The temperature in this discharge is approximately 5000° C., so that the sample is usually completely dissociated and ions of each of the elements present in it are formed.

The discharge is directed against a cooled cone containing in its apex a small hole leading to a first evacuated region. A skimmer cone also having a hole at its apex, is situated downstream of the first cone and divides the first evacuated region from a second evacuated region in which a mass analyser may be situated. The mass analyser, and the holes in both cones, lie on the same axis. Typically a quadrupole mass analyser is employed. The skimmer cone and the first evacuated region comprise a conventional pressure reduction stage. In some instruments, a two stage system for pressure reduction is employed. This comprises another evacuated region situated downstream of the skimmer cone and separated from the second region by a diaphragm containing a hole on the same axis as the other holes.

Ions generated in the plasma discharge pass through the holes and are subsequently mass-analysed by the mass analyser. Various arrangements of electrostatic lenses are used to maximize the transmission of ions from the discharge into the analyser. The majority of the ions formed are singly charged ions of each of the elements present in the discharge, so that a mass spectrometer with an inductively-coupled plasma source (ICPMS) is a valuable instrument for determining the elemental composition of a sample, especially of inorganic materials such as metallic alloys or geological samples. Descriptions of prior art ICPMS instruments, and some typical applications, are given by Gray, A. L., and Date, A. R., in the following articles:

(a) Int. J. Mass Spectrum. and Ion Phys, 1983, vol. 46, pp 7–10.

(b) ibid, 1983, vol. 48, pp 357–360, and (c) The Analyst, 1983, vol. 108, pp 159–165.

ICPMS instruments are very sensitive and are often used for the determination of trace quantities. However, the presence of background peaks at certain masses reduces the sensitivity to certain elements especially when a background peak coincides with the peak usually used to determine a particular element. There appear to be four principal types of these interfering background peaks:

(a) major peaks due to the elements of H, C, N, O and Ar present either basic constituents or as impurities in the sample solution or carrier gas;

(b) oxide or hydroxide molecular ion peaks, formed mainly from elements with refractory oxides, and which appear to be formed mainly in the "boundary layer" of gas in the plasma adjacent to the cooled plate against which the discharge is directed;

(c) atomic and molecular ions formed by reaction of ions or atomic species present in the discharge with the surfaces which they contact, e.g, metal ions formed by sputtering of the cooled cone;

(d) molecular ions such as $ArN^+$ and $ArO^+$ which are formed by ion-molecule and condensation reactions taking place after the ions leave the plasma and before they reach the spectrometer.

Obviously, interfering peaks due to argon and the constituents of the solution are unavoidable, but those due to impurities can be minimized by the use of pure materials. Peaks due to ions of oxides and hydroxides of refractory metals formed in the boundary layer are difficult to eliminate completely, although it is possible to minimize the amount of boundary layer gas which enters the hole in the sampling cone. This is done by adjusting the shape of the cooled cone at which the discharge is directed, and selecting the shape and size of the hole. These peaks are usually the least important of the interferences.

Early ICPMS instruments had only a small hole in the cooled cone, so that the boundary layer of cooler gas extended over the hole and ions were sampled from this layer. However, it was found that background peaks due to molecular ions were smaller when the hole size was increased, so that the boundary layer was punctured and ions were sampled from the hottest part of the plasma. Unfortunately, this also causes increased arcing in the vicinity of the hole, which increases the background due to both molecular and atomic ions formed by sputtering, etc, and decreases the lifetime of the cone by accelerating the erosion of the edges of the hole. P. J. Douglas, in European patent application No. 112004, explains that the arcing can be reduced by minimizing the potential gradients existing in the plasma. He suggests that this is done by modification of the RF generator used to supply energy to the plasma. The present inventor has found that although this is successful in reducing arcing and the rate of erosion of the cone, it results in an increase in the formation of molecular ions which have their origin in recombination and condensation reations, and the resulting background spectra are reminiscent of those obtained with the earlier "boundary-layer sampling" ICPMS instruments. It appears that some arcing at the orifice is unavoidable if the intensity of these molecular-ion peaks is to be kept at an acceptable level. (For example, see Olivares, J. A, and Houk, R. S, Anal. Chem. 1985, 57 pp 2674–2679.) Careful design of the shape of the sampling cone can reduce problems due to erosion and a high background due to sputtered ions, and the instrument can be designed to permit replacement of the sample cones in a very short time. Despite these advances, however, the intensity of some of the molecular ion peaks in the background spectra of prior instruments is still high enough to limit the sensitivity of the instrument to certain elements.

It is the object of the present invention to provide an ICPMS instrument in which the intensity of the background spectrum is substantially lower than that of prior instruments, and which consequently has lower detection limits for the elements whose determinations are adversely affected by peaks in the background spectrum.

The invention provides a mass spectrometer comprising:

(a) means for generating a high-temperature plasma in a flow of carrier gas by means of an inductively-coupled radio frequency electrical generator;

(b) means for introducing a sample into said plasma;

(c) a sampling member having a front surface adjacent to said plasma, a rear surface, and a hole connecting said front and rear surfaces through which ions formed in said plasma can pass;

(d) a chamber having a wall comprising the rear surface of said sampling member;

(e) means for maintaining the pressure in said chamber substantially below atmospheric pressure, and (f) means for causing at least some of the ions entering said chamber through said hole to enter a mass analyser;

wherein a smooth area is provided on the rear surface of said sampling member at least in the vicinity of said hole.

Typically, a mass spectrometer according to the invention will comprise a hollow conical sampling member with the hole at the apex of the cone. This is disposed so that the apex of the cone protrudes into the plasma. The included angles of the outer surface in contact with the plasma (i.e, the front surface) and the inner surface are usually different, so that the thickness of the walls of the cone reduces in the vicinity of the hole. It will be appreciated that a cone of this type is most conveniently made by turning, and as a consequence the inner rear surface will be typical of a turned surface and is likely to be quite rough. Up to now, the nature of this surface has been thought to have no significant effect on the operation of the mass spectrometer, and no special care has been taken in the manufacture of the cones. Preferably, said smooth area is obtained by polishing the rear surface of said sampling member. The term polishing in this statement is meant to include mechanical processes such as buffing and lapping and electropolishing. The resulting surface finish of the smooth area should preferably be less than five microns for maximum advantage to be gained from the invention. The edges of the hole, however, should preferably not be rounded during the polishing process, otherwise the performance of the spectrometer may be adversely affected.

Preferably the smooth area should extend radially from the hole to a part of the rear surface which is so far removed from the axis joining the hole to the mass analyser that ions formed close to that part do not enter the mass analyser. For a typical sampling cone of about 4 cm diameter at its widest part, the polished area should extend at least as far as 1 cm from the hole. In practice it is often easier to polish the whole of the inner rear surface.

According to another aspect the invention provides a method of reducing the intensity of at least part of the background spectrum observed on a mass spectrometer in which samples are ionized by means of an inductively-coupled plasma discharge in a carrier gas, and in which ions are sampled from said plasma through a hole in a sampling member, said sampling member having a front surface adjacent to said plasma and a rear surface which forms part of the wall of an evacuated chamber containing means for causing ions sampled through said hole to enter a mass analyser, said method comprising polishing said rear surface at least adjacent to said hole.

Preferably the surface area of the rear surface of the sampling member is reduced by polishing, buffing or lapping, although other processes such as electropolishing can be used. Preferably also the surface finish of the polished area should be 5 microns or better.

The inventor has found that if the rear surface of the sampling member is polished as described, the formation of molecular ions such as $ArN^+$ and $ArO^+$ can be reduced by at least a factor of ten. As the major isotopes of these peaks occur at masses 54 and 56 they seriously interfere with the determination of metals such as Mn and Fe, (major isotopes at 55 and 56). Consequently, reduction of background peaks due to $ArO^+$ and $ArN^+$ according to the invention decreases the detection limits for the metals. It has also been found that polishing according to the invention reduces the intensity of other interfering background peaks such as $^{58}Ni$, which is presumably formed by sputtering of a sampling member containing nickel, thereby decreasing the detection limit for Ni as well.

An embodiment of the invention will now be described by way of example with reference to the figures, in which.

Figure 1:
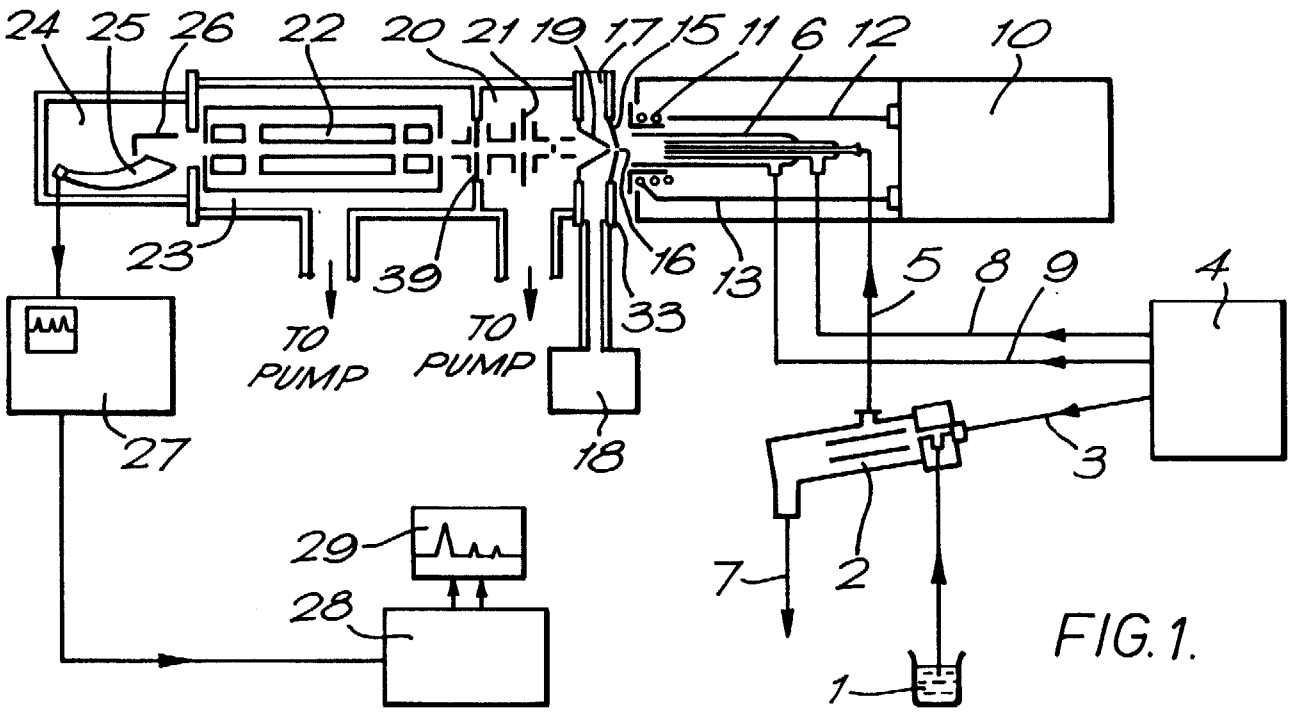
FIG. 1 is a schematic diagram of a mass spectrometer according to the invention.

Referring first to FIG. 1, a solution 1 of the sample to be analysed is admitted to a pneumatic nebuliser 2 which is fed by a flow of argon gas in pipe 3 from gas supply unit 4. The sample, entrained in argon gas, is introduced into a conventional ICP torch 6 though pipe 5, and excess solution is drained from the nebuliser 2 through drain 7. Gas-supply unit 4 provides two other controlled flows of argon to torch 6 though pipes 8 and 9. A radio-frequency electrical generator 10 supplies energy to coil 11 via leads 12 and 13 so that a plasma discharge 14 (FIG. 2) is formed at the end of torch 6.

ICP torch 6, and its associated equipment including unit 4, coil 11, generator 10 and nebuliser 2 are conventional items of equipment and need not be described further. Details of suitable equipment is given by Houk, Fassel, Flesch, Svec, Gray and Taylor in Analytical Chemistry, 1980 52, pp 2283–89, and by Fassel and Kniseley in Analytical Chemistry, 1974, 46, pp 1155A–1164A.

The plasma discharge 14 is directed against sampling member 15 mounted on cooled flange 33 and containing a hole 16 which communicates with chamber 17. A vacuum pump 18 maintains chamber 17 substantially below atmospheric pressure, typically at 1 torr. A skimmer cone 19 with a hole in its apex separates chamber 17 from chamber 20 which is evacuated by a diffusion pump (not shown). Chamber 20 contains electrostatic lens 21 which causes ions passing through the holes in skimmer cone 19 and sampling member 15 to be efficiently transmitted to quadrupole mass analyser 22. Analyser 22 is enclosed in a chamber 23 which is isolated from chamber 20 by a diaphragm 39 which contains a small hole to allow ions to pass from lens 21 into analyser 22. Chamber 23 is mainained at a lower pressure than chamber 20 by a second diffusion pump (not shown).

Ions which pass through mass analyser 22 enter ion detector 24 where they strike converter electrode 26, releasing secondary electrons which enter electron multiplier 25. The electrical signal generated by multiplier 25 is amplified by an amplifier in display unit 27, which in turn feeds a digital computer 28 and terminal 29 to allow further processing of the data. It will be appreciated that lens 21, analyser 22, detector 24, display unit 27 and computer 28 are conventional components of a quadrupole mass spectrometer and its data handling system and need not be described in detail.

Figure 2:
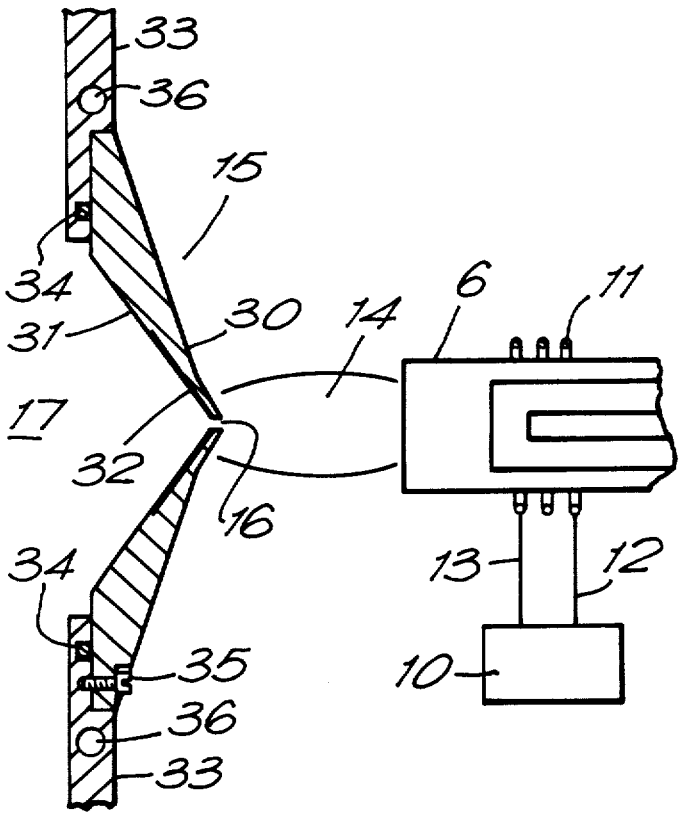
FIG. 2 is a drawing illustrating a sampling member suitable for use in the invention.

FIG. 2 shows the plasma discharge and sampling member in more detail.

Sampling member 15 is formed in the shape of a hollow cone having a front surface 30 in contact with the discharge 14 and a rear surface 31 forming part of a wall of chamber 17. Ions formed in the discharge 14 pass through hole 16 and subsequently through the hole in skimmer cone 19 (FIG. 1), entering mass analyser 22 via lens 21. Sampling member 15 is easily removable from its mounting flange 33 to facilitate cleaning or replacement. As shown in the figure it is sealed to flange 33 by a rubber 'O' ring 34 in a circular groove in flange 33, and secured by three screws 35. Flange 33 is cooled by means of a flow of coolant in drilled passages 36, which are disposed in a square round the edges of sampling member 15. In this way the temperature of member 15 is minimized and damage to 'O' ring 34 is prevented. As an alternative to the provision of passages 36, pipes through which a coolant is passed may be brazed to flange 33.

As explained, the advantage of the invention is gained by polishing the rear surface 31 of sampling member 15 in region 32 (FIG. 2). The polished region extends from hole 16 to a part of member 15 which is so far removed from the common axis of hole 16, lens 21 and analyser 22 that ions formed there are unlikely to enter analyser 22. Typically, sampling member 15 is of about 4 cm diameter and hole 16 approximately 0.5 mm diameter, and region 32 will extend for about 1 cm radius along rear surface 31. The required surface finish of 5 microns or better can be achieved by any suitable means, but mechanical polishing and buffing is the most suitable. Care should be taken to avoid rounding the edges of hole 16 during the polishing process. Electropolishing of the sample member 15 is also possible, but tends to increase the size of hole 16. In practice it is more convenient to polish the whole of rear surface 31.

Figure 3:
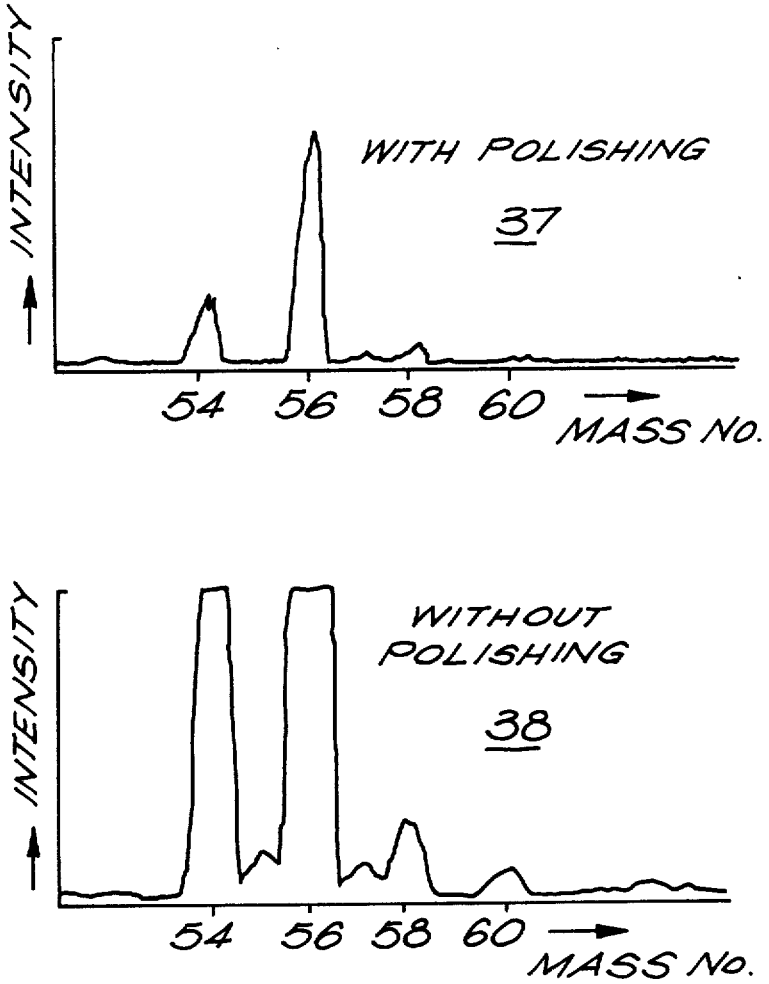
FIG. 3 shows the background mass spectra obtained from the spectrometer of FIG. 1 both with and without application of the invention.

FIG. 3 shows two background mass spectra 37 and 38 obtained on the same ICPMS instrument using a sampling member polished according to the invention (spectrum 37) and using a conventional (unpolished) sampling member (spectrum 38). The two spectra are shown at the same sensitivity. It is clear that the background spectrum 37 obtained with the polished sampling member has peaks of much lower intensity than those observed in spectrum 38 obtained with the conventional sampling member. Table 1 shows a comparison between the intensities of some background peaks measured on an instrument fitted with an unpolished sampling member and the same instrument fitted with a sampling member polished according to the invention. (ppb=concentration of a solution of $In^+$ (in ng/ml) which would yield a peak of the same intensity.)

TABLE 1

| Ion | Mass | Unpolished Member (ppb) | Polished Member (ppb) |
|---|---|---|---|
| $ArN^+$ | 54 | 65 | 6 |
| $ArO^+$ | 56 | 200 | 20 |
| $Ni^+$ | 58 | 12 | <1 |

From Table 1 it can be seen that background peaks due to $ArN^+$, $ArO^+$, and $Ni^+$ are reduced by about a factor of 10 by application of the invention. This is presumably due to the reduction in the surface area of rear surface 31, on a microscopic scale, by the polishing process. The details of the chemical processes which lead to the formation of these background ions are not understood, but it is likely that ions such as $ArN^+$ and $ArO^+$ are formed by catalytic processes taking place at active sites on the rear surface 31 of the sampling member 15 close to hole 16. This is understandable because the expanding jet of plasma components emerging into chamber 17 from hole 16 diverges at a large angle and contacts surface 31, which is at a very high temperature near hole 16. Consequently, it is not essential that the whole of surface 31 or flange 33 is polished, because ions formed some distance from hole 16 will not be mass analysed. The extent of surface 31 which requires to be polished is dependent on the size and shape of member 15 and hole 16, and the characteristics of discharge 14 and lens 21. Therefore, the polishing should extend from hole 16 for a distance at which it is found by experiment that adequate reduction of the intensity of the background peaks is obtained. In practice, with sampling members of the type shown in FIG. 2, it is best to polish the whole of surface 31 for simplicity, but only a portion 32 need be polished to obtain the advantages of the invention.

It will be seen from FIG. 3 and Table 1 that the polishing process also reduces the intensity of the $^{58}Ni^+$ peak observed when sampling members containing Ni are used. This appears to be due to the reduction in arcing, and therefore sputtering of sample member material, which is also a consequence of the polishing. As explained, arcing is affected by the shape of the sampling member and the voltage swing in the plasma discharge 14. It is not desirable that arcing should be completely eliminated, but it is clear that the reduction achieved by polishing is beneficial in controlling the quantity of the sputtered background ions. Presumably, arcing is reduced as a consequence of the reduction in the number of active sites on surface 31 brought about by polishing.

Although an embodiment of the invention which incorporates a hollow conical sampling member 15 has been described, the invention is not limited to the use of such a member. The advantage of the invention can also be gained if other types of sampling members are used, for example, a flat disc with a hole at its centre. In this case, the rear surface of the disc close to the hole is polished.

What is claimed is:

1. In a mass spctrometer comprising:

(a) means for generating a high-temperature plasma in a flow of carrier gas by means of an inductively-coupled radio-frequency electrical generator;

(b) means for introducing a sample into said plasma;

(c) a sampling member having a front surface adjacent said plasma, a rear surface, and a hole connecting said front and rear surfaces through which ions formed in said plasma can pass;

(d) a chamber having a wall comprising said rear surface;

(e) means for maintaining the pressure in said chamber substantially below atmospheric pressure; and (f) means for causing at least some of the ions entering said chamber through said hole to enter a mass analyzer;

the improvement comprising the provision by polishing of a smooth area with a surface finish of 5 microns or less on said rear surface at least in the vicinity of said hole.

2. A mass spectrometer according to claim 1 in which:

(a) said sampling member comprises a hollow cone and said hole is disposed in the apex of said cone; and (b) said sampling member is disposed with said apex protruding into said plasma.

3. A mass spectrometer according to claim 1 in which said smooth area extends from said hole at least as far as a region in and beyond which substantially no ions formed enter said mass analyser.

4. A mass spectrometer according to claim 2 in which said smooth area extends from said hole at least as far as a region in and beyond which substantially no ions formed enter said mass analyser.

5. A method of reducing the intensity of at least part of the background spectrum observed on a mass spectrometer in which samples are ionized by means of an inductively-coupled plasma discharge in a carrier gas, and in which ions are sampled from said plasma through a hole in a sampling member, said sampling member having a front surface adjacent said plasma and a rear surface which forms part of the wall of an evacuated chamber containing means for causing the ions sampled through said hole to enter a mass analyzer, said method comprising polishing said rear surface at least adjacent to said hole until the surface finish on said rear surface is 5 microns or less.

6. A method according to claim 9 in which said polishing extends from said hole at least as far as a region in and beyond which substantially no ions formed enter said mass analyser.

* * * * *